US006217656B1

(12) United States Patent
Spiering et al.

(10) Patent No.: US 6,217,656 B1
(45) Date of Patent: Apr. 17, 2001

(54) PAN HOLDER FOR COATING PROCESS

(75) Inventors: Charles E. Spiering; Kurt R. Wilker, both of Manitowoc, WI (US)

(73) Assignee: Newell Operating Company, Freeport, IL (US)

( * ) Notice: Subject to any disclaimer, the term of this patent is extended or adjusted under 35 U.S.C. 154(b) by 0 days.

(21) Appl. No.: 09/227,131

(22) Filed: Jan. 7, 1999

(51) Int. Cl.[7] ..... B05C 13/02

(52) U.S. Cl. ..... 118/500; 118/503; 269/8; 269/57; 269/288; 269/900; 248/154; 248/346.03; 248/346.5; 279/112; 279/128

(58) Field of Search ..... 118/500, 503, 118/306, 318, 319, 320, 322, 324, 408; 427/236, 233, 239, 425; 279/110, 112, 128; 269/8, 57, 53, 54.5, 287, 288, 900; 248/346.5; 211/184

(56) References Cited

U.S. PATENT DOCUMENTS

| | | | | |
|---|---|---|---|---|
| 13,787 | * | 11/1855 | Horton . | |
| 3,087,827 | | 4/1963 | Klenke, Jr. et al. . | |
| 3,087,828 | | 4/1963 | Linton . | |
| 3,087,829 | | 4/1963 | Linton . | |
| 4,014,834 | | 3/1977 | Concannon . | |
| 4,087,394 | | 5/1978 | Concannon . | |
| 4,118,537 | | 10/1978 | Vary et al. . | |
| 4,123,401 | | 10/1978 | Berghmans et al. . | |
| 4,180,609 | | 12/1979 | Vassiliou . | |
| 4,351,882 | | 9/1982 | Concannon . | |
| 4,637,303 | * | 1/1987 | Lucky | 99/426 |
| 4,989,846 | * | 2/1991 | Quinn | 269/900 |
| 5,079,073 | | 1/1992 | Tannenbaum . | |
| 5,240,775 | | 8/1993 | Tannenbaum . | |

(List continued on next page.)

FOREIGN PATENT DOCUMENTS 1131038 10/1968 (GB) .

*Primary Examiner*—Laura Edwards
(74) *Attorney, Agent, or Firm*—Foley & Lardner

(57) ABSTRACT

A holder is provided for holding a pan or other article during the process of applying a coating, such as a non-stick release coating, to the article's surface. The pan holder includes a pan holding member for holding the pan in position on the pan holder, and a pan holder chuck attached to the pan holding member. The holding member may include a bottom support piece and a plurality of pan support rods extending from the bottom support piece. At least one of the support rods is preferably movable and biased in an inward radial direction for holding the pan in position against the other support roads. The movable support rod may also include therefor for engaging a handle stud extending from a pan. The pan holder chuck includes a downward extending shaft for mounting the pan holder on a conveyor chain in a chain-on-edge spray line, and a pulley adapted to be engaged by a drive belt for rotating the pan holder while a coating material is sprayed onto an article held by the pan holder. The pan holder may be provided with a magnetizable die pattern and a magnet for applying a magnetic force to the die pattern which, in turn, is directed through a pan held in the pan holder for re-orienting reflective magnetizable metal flakes dispersed in a pan coating material to form a pattern in the shape of the die pattern in the coating. The pan holder prevents movement of a pan with respect to the die pattern to thereby prevent blurring of the re-oriented magnetizable flake pattern formed in the coating. A spacer piece may be positioned between the magnet and the die pattern to provide a diffuse magnetic field to the die pattern. The magnet may be contained in a magnet housing. The magnet housing and pan holder chuck may be formed as a sub-assembly adapted for use in combination with pan holders for holding differently sized pans.

41 Claims, 3 Drawing Sheets

U.S. PATENT DOCUMENTS 5,250,356 10/1993 Batzar .
5,398,898 * 3/1995 Bever ..... 248/154
5,456,754 * 10/1995 Matheson et al. ..... 118/319
5,562,991 10/1996 Tannenbaum .

* cited by examiner

PAN HOLDER FOR COATING PROCESS

FIELD OF THE INVENTION

This invention pertains generally to containers such as pans and other cookware articles and methods for making such articles, and, more particularly, to systems and methods for applying coatings, such as non-stick release coatings, to such articles, and for holding the articles during a coating application process.

BACKGROUND OF THE INVENTION

Articles of cookware, such as pans of various sizes, may be made of a variety of substrate materials, such as ceramic, glass, or metal materials, such as stainless steel, copper, or aluminum. Often it is desirable to apply a coating to at least the interior surface of such cookware articles. Various types of coatings may be applied, including coatings designed to protect the inside surface of the cookware from damage due to abrasion and/or corrosion, and/or to provide a non-stick release coating on the inside surface of the cookware article so that food cooked in the cookware is easily removed therefrom.

Although various methods, such as roller and dip coating, may be used to apply a coating to the inside surface of an article of cookware, coatings are typically applied to cookware by spraying a desired coating material onto the interior surface of the cookware. Modern cookware coatings, such as non-stick release coatings, require several coating material application and curing steps to achieve the desired surface finish. For example, a non-stick release coating may be applied to the interior surface of a metal pan by applying a primer material to the inside pan surface, drying the primer layer in a hot air environment, applying one or more intermediate and top coats of non-stick material over the primer layer, and then curing or baking the pan once again in a hot air environment.

Effective and efficient processes have been developed for applying coatings to articles of cookware in a mass production industrial setting. Such industrial processes involve conveying a series of articles of cookware to be coated through each step in a coating process. A typical process for applying a coating to the inside surface of an article of cookware employs a chain-on-edge spray line. A chain-on-edge spray line employs a conveyor chain to transport articles of cookware through various stages in a process whereby coating materials are applied to the cookware and where the applied coating materials are dried or cured. The conveyor chain is formed of a plurality of links. Each link has a central aperture formed therein. A plurality of pan holders are mounted spaced apart on the conveyor chain. Each pan holder includes a pan holder chuck, whereby the pan holder is mounted on the conveyor chain, and a pan holding means, attached to the chuck, for holding a pan or other article which is to be transported through the coating process stages. The pan holder chuck includes a shaft, which extends downward through the central aperture in a link in the conveyor chain, and a pulley mounted to the shaft. The pulley is adapted to be engaged by a drive belt, which rotates the shaft, and, therefore, the entire pan holder, with respect to the conveyor chain. The pan holding means is typically implemented as a cylinder or other receptacle, having an upward facing opening formed therein adapted to receive a pan or other article of cookware to be coated. A pan blank, or other article of cookware to be coated, is dropped into the opening in the pan holding means. The pan is held in place in the holding means by the weight of the pan.

A pan held in the pan holder is transported through the various coating process stations by the conveyor chain. At a first processing station, for example, a primer material may be applied onto the interior surface of the pan. This may be achieved by extending a spray nozzle near or into the interior of the pan, and spraying a primer material in liquid form from the nozzle onto the interior surface of the pan. To ensure a relatively even coating of material is applied on the pan surface, the pan is preferably rotated as the primer material is sprayed thereon. A drive belt is thus provided in the primer material application station. The drive belt is positioned such that the pulley on the pan holder chuck engages the drive belt as the conveyor chain transports the pan holder through the primer application station. The drive belt rotates the pan holder, and the pan attached thereto, via the pulley while the primer coating material is sprayed onto the interior surface of the pan. Following the primer application station, the pan may be conveyed by the conveyor chain through a heat curing station, and one or more intermediate and/or top coat application stations, wherein, for example, one or more coats of non-stick coating material may be applied to the interior surface of the pan. Since the pan blank need not be rotated during the curing stage, a drive belt is typically not provided in the curing station. The intermediate and top coats of material may be applied in a manner similar to the manner in which the primer coating is applied, e.g., by spraying the material onto the interior surface of the pan while the pan is rotated. Thus, drive belts are typically provided in all of the coating material application stations to engage the pulley mounted on the pan holder chuck, to thereby rotate the pan holder and the pan held therein during the coating application process. After all coating material layers have been applied, the coated pan blank or other article is removed from the pan holder for further curing and/or processing steps.

For most conventional cookware coatings, such as most non-stick release coatings, the coating application process just described is efficient, effective, and economical. The pan holders employed in such a process are relatively inexpensive. The pan holding means employed, however, do not hold pans transported thereby tightly in position during the coating application process. A pan blank, which is held in position in the pan holder by its own weight, will shift position during the coating application process. For many applications, however, this pan movement does not seriously adversely affect the quality of the finished product.

Recently, a method has been developed for producing a pattern in the non-stick release coating applied to the interior surface of an article of cookware by magnetically reorienting reflective magnetizable flakes dispersed in the non-stick coating material. Reflective flakes made of a magnetizable material, such as iron, nickel, and alloys containing these metals, such as stainless steel, are mixed in a liquid fluoropolymer non-stick coating material. The non-stick coating material, with the metal flakes mixed therein, is applied to the inside surface of an article of cookware in a conventional manner, e.g., by spraying the material onto the inner surface of the cookware. In the absence of a magnetic field, the magnetizable reflective flakes will be oriented parallel to the cookware surface, i.e., horizontally. However, if a magnetic field is applied to the cookware, either during application of the coating material to the cookware or after application of the coating material but before the coating material dries or hardens, the reflective magnetizable flakes in the magnetic field will become aligned with the magnetic field, i.e., will be reoriented vertically or perpendicular to the cookware surface. When the non-stick coating material is cured, the reoriented magnetizable reflective flakes will be fixed in this vertical position. The horizontally oriented reflective flakes will reflective light back to an observer, the vertically oriented flakes will not. Thus, a pattern, which appears three dimensional to the eye, is created in the non-stick release coating of the cookware. As long as the magnetizable reflective flakes are selected to have the proper dimensions, i.e., no longer than slightly more than the thickness of the fluoropolymer non-stick release coating, the pattern formed in the coating in this manner will not adversely affect the performance of the non-stick release coating.

The shape of the pattern produced in the release coating of the cookware is defined by the shape of the magnetic field applied to the cookware while the fluoropolymer release coating material containing the magnetizable flakes is applied thereto in liquid form. A magnetic field of the desired shape can be achieved by placing a die pattern, e.g., a metal plate in the shape of the desired pattern to be produced in the cookware release coating, against an outside of the cookware, with a magnet (either a permanent magnet or an electromagnetic) placed against the die pattern. The magnet and die pattern in combination produce a magnetic field in the shape of the die pattern on the inside surface of the cookware while the fluoropolymer release coating material containing the magnetizable reflective flakes is applied to the interior surface of the cookware, or after the coating is applied, but before the coating solidifies to thereby reorient a portion of the metal flakes in the coating material in the shape of the die pattern. Such a process is described, for example, in Great Britain Patent No. 1,131,038. This process can, however, produce a "fuzzy" pattern, i.e., a pattern which lacks clarity, in the cookware release coating. When a shaped die pattern is laid directly across the top of the magnet, the resultant imprint of the die pattern formed in the release coating is especially fuzzy where the magnetic force of the magnet is directed through the bulk area of the die pattern. The fuzzy image is a manifestation of unwanted field lines (magnetic background effects). If a stronger magnet is used to try to eliminate the fuzziness of the image, i.e., sharpen the image, another unwanted background effect occurs, namely reproduction of the shape of the magnet itself in the pattern formed in the coating. It has been found that a sharper image pattern may be formed in the release coating if the magnetic force applied to the magnetizable reflective flakes is from a diffused magnetic field, rather than directly from the magnet itself. This is achieved by spacing the magnet, which is the source of the magnetic force, away from the substrate being coated. Magnetic force is thus preferably communicated across the space between the magnet and the flakes in the coating from a diffuse magnetic field intervening between the magnet and the coating through the die pattern of magnetizable material positioned between the diffused magnetic field and the coating on the substrate. The diffused magnetic field isolates the coating from direct exposure to the magnetic field of the magnet, eliminating unwanted background effects from the pattern, thereby improving pattern clarity. A diffused magnetic field may be created by placing a magnetizable diffusion plate between the magnet and the die pattern and/or by spacing the magnet from the dye pattern such that the coating on the substrate is not directly exposed to the magnetic force of the magnet. Such a process is described in U.S. patent application Ser. No. 09/144,766, filed on Sep. 1, 1998 now U.S. Pat. No. 6,103,361.

It is desirable that conventional industrial processes for applying coating materials to cookware articles be adapted to the production of cookware articles having patterns formed in the non-stick release coatings thereof by the magnetic reorientation of reflective magnetizable flakes in the coating material, in the manner described.

SUMMARY OF THE INVENTION

The present invention provides a pan holder for holding an article of cookware in position while applying a coating material thereto. A pan holder in accordance with the present invention is especially adaptable for holding an article of cookware in position during the process of applying a non-stick release coating material to the interior thereof. In particular, a pan holder in accordance with the present invention holds an article of cookware in position in the pan holder while a non-stick release coating material is sprayed onto the interior surface of the cookware as the cookware is rotated. The pan holder of the present invention prevents movement of the article of cookware with respect to the pan holder during such rotation. A pan holder in accordance with the present invention will find particular applicability in processes for forming patterns in the non-stick release coatings of articles of cookware by the magnetic orientation of reflective magnetizable flakes in the coating materials applied thereto. For such applications, a pan holder in accordance with the present invention may include a magnetizable die pattern and a magnet for providing magnetic force to the die pattern to produce a magnetic field in the shape of the die pattern through a pan or other article of cookware being held in the pan holder during the application thereto of a release coating material having reflective magnetizable metal flakes mixed therein. The magnetic field thus applied to the article of cookware reorients a portion of the metal flakes in the shape of the die pattern. The pan holder of the present invention holds the pan or other article of cookware tightly against the die pattern during the coating material application process. Thus, fuzziness, or a lack of clarity in the pattern produced in the release coating, which might be caused by movement of the pan with respect to the die pattern during application of the coating material, is prevented.

A pan holder in accordance with the present invention includes a pan holding means and a pan holder chuck. The pan holding means includes a bottom support piece and at least two, but preferably three or more, pan support rods extending vertically from the bottom support piece. The bottom support piece may be plate or ring shaped, and is preferably made of a non-magnetic material, such as aluminum. The pan support rods may extend directly from the bottom support piece, or may be attached to the bottom support piece via support arms which extend radially from the bottom support piece. The pan support rods are positioned and spaced from each other on the bottom support piece so as to provide means for holding a pan or other article of cookware between them.

Preferably at least one of the support rods is moveable in a radial direction, and is biased inward toward the axial center of the pan holder. For example, a moveable support rod may be attached in a hinged relation to the bottom support piece, or to a support arm extending therefrom. A compression spring may be positioned against the moveable support rod to bias the rod toward the axial center of the pan holder. Thus, when a pan or other article is positioned in the pan holding means, between the pan support rods, the moveable support rod is biased against the pan to press the pan against the other support rods, thereby holding the pan in position on the pan holder. The movable support rod also ensures that a pan or other article is held in position in the pan holder despite slight inconsistencies in the diameter of a pan or other article.

The movable vertical support rod preferably also includes a means for engaging the handle studs typically found on a pan blank or article of cookware shell. The handle studs extend from the pan blank for attaching a handle thereto. For example, the movable vertical support rod may include two extending portions extending therefrom, with a notch formed between the extending portions. The handle stud on a pan blank or shell is positioned in the notch when the movable support rod is biased against the pan blank. The means for engaging the handle stud thus provides further support for the pan blank within the pan holder, thereby enhancing the ability of the pan holder to prevent movement of the pan blank in the holder during rotation thereof.

The pan holder chuck is attached to the bottom support piece of the pan holding means. The pan holder chuck includes a vertically extending chuck shaft and a pulley attached to and around the shaft. The chuck shaft is designed to extend into the central aperture of a link in a conveyor chain in a chain-on-edge spray line. The pulley is adapted to be engaged by a drive belt as the pan holder is transported by the conveyor chain through a coating material application station. The drive belt rotates the pan holder, and a pan held therein, via the pulley, while a coating material is sprayed onto the interior surface of the pan blank in the coating application station. The pulley may be attached permanently to the shaft, or may be attached thereto using a set screw or other mechanism whereby the position of the pulley on the shaft may be adjusted to accommodate various drive belt positions with respect to the conveyor chain.

A pan holder in accordance with the present invention may be adapted for use in an industrial process for forming a pattern in a non-stick release coating applied to a pan or other cookware article by the magnetic reorientation of reflective magnetizable flakes distributed in the coating material. Such a pan holder in accordance with the present invention includes a magnetic die pattern and a magnet attached to the pan holder holding means and chuck. The die pattern is made of a magnetizable material formed in the shape of a desired pattern to be formed in the release coating applied to the cookware article. The die pattern is positioned on the bottom support piece, between the pan support rods. When a pan blank is positioned in the pan holder holding means between the support rods, an outside surface of the pan blank is held in contact with the die pattern thereby. The magnet, which may be an electromagnet or a permanent magnet, is magnetically coupled to the die pattern. The magnet may be attached directly to the die pattern, but is preferably coupled to the die pattern through a spacer piece, which is preferably made of a magnetic material. The spacer piece defuses the magnetic field generated by the magnet as applied to the die pattern, which results in a sharper image produced in the release coating of the cookware. The spacer piece may be attached to the bottom support piece of the pan holding means, between the magnet and the die pattern. Preferably, the spacer piece is attached to a ring shaped bottom support piece in a central aperture thereof. The die pattern is attached directly to the spacer piece, such as by threading the die pattern onto a threaded insert extending vertically from the spacer piece along the axis of the pan holder. The magnet is attached to the spacer piece, and may be held in position thereon by fasteners or by the magnetic force between the magnet and the spacer piece.

The magnet is preferably contained in a magnet housing, which is made of a non-magnetic material, such as plastic. The magnet housing may include a recessed top surface and/or notches or other alignment means formed therein for engaging a corresponding stepped bottom notches, or other alignment means formed in the spacer piece, to provide proper alignment between the magnet housing and the spacer piece, and to prevent rotation of the magnet housing with respect to the spacer piece. The pan holder chuck, including the shaft and pulley, may be attached to the pan holder holding means via the magnet housing. Thus, the chuck may be attached to the magnet housing, such that the chuck is attached to the pan holder holding means when the magnet housing is attached to the spacer piece.

The spacing between the pan support rods on the pan holding means of a pan holder in accordance with the present invention defines the size of cookware article which may be held by the pan holder. Means may be provided for changing the length of the support rods, to allow the pan holder to hold a cookware article which is larger or smaller in the vertical direction, or for allowing the pan support rods to be moved in a radial direction, to allow the pan holder to hold an article of cookware having a larger or smaller radius. Alternatively, the pan support rods may be mounted at a fixed height and/or in a fixed position on the pan holder. In such a case, different pan holder holding means, having support rods mounted thereon with different spacings between rods, will be required for holding differently sized pans. Preferably, the magnet housing, including the magnet therein, and having the pan holder chuck, including the chuck shaft and pulley, attached thereto, may be provided as a magnet/chuck assembly which is easily detachable from and attachable to the pan holding means of a pan holder in accordance with the present invention. Such a magnet/chuck assembly may be used in combination with pan holder holding means having pan support rods with various spacings therebetween attached thereto. Thus, a single magnet/chuck assembly in accordance with the present invention may be employed with pan holder holding means which are adapted for use with various sized articles of cookware. Since the magnet and chuck components form a significant portion of the cost of a pan holder in accordance with the present invention, significant cost savings can be had if a single magnet/chuck assembly in accordance with the present invention is adapted for use with pan holding means adapted to hold differently sized pans.

In operation, a plurality of pan holders in accordance with the present invention are mounted spaced apart on a conveyor chain for transporting pans or other articles of cookware through various stations at which the various steps of a coating process are performed. For example, pan holders in accordance with the present invention may be placed approximately 18" apart in apertures formed in the links of a conveyor chain in a chain-on-edge spray line. Each pan holder is mounted on the conveyor chain by extending the pan holder chuck shaft through a link in the chain. A pan blank or other cookware shell is positioned in each pan holder holding means between the pan support rods thereof. At least one of the support rods preferably is a movable support rod which is biased radially against the pan blank, to hold the pan blank in place in the pan holding means. A handle stud formed on the pan blank may be positioned in a handle stud engaging means formed on the movable pan support rod, to provide additional support against movement of the pan blank. The pan blank may be held in place against a magnetic die pattern, which may be attached to the pan holder by the support rods. A magnet and spacer piece may be coupled to the die pattern, thereby generating a diffuse magnetic field through the article of cookware in the shape of the die pattern.

A pan holder in accordance with the present invention may be employed in various processes for applying coatings to the surfaces of containers, such as articles of cookware. A pan holder in accordance with the present invention will be found particularly useful in processes for applying a non-stick release coating to an article of cookware wherein reflective magnetizable flakes in the coating material are re-oriented in a pattern to form a visible pattern in the release coating. Such a process may involve several processing steps, performed at a series of processing stations. A pan blank, or other article of cookware, which is to have such a patterned release coating formed thereon, is transported through the various processing stations using a pan holder in accordance with the present invention. The pan holder of the present invention holds the pan blank in position against a magnetizable die pattern during the various steps of the coating application process. Such steps may include, for example, the application of a primer coating material to the uncoated pan blank, drying of the primer coating, the application of an intermediate coat of release material, having reflective magnetizable flakes suspended therein, over the primer layer, and the application of a top coat of release coating material over the intermediate coat. The primer, intermediate, and top coats are preferably applied by spraying the coating materials onto the surface, e.g., the interior surface, of the pan blank as the pan blank is rotated. The pan holder in accordance with the present invention holds the pan blank in position in the pan holder during such rotation. Holding the pan blank in position against the magnetized die pattern during the application of a coating material, containing the reflective magnetizable flakes therein, ensures that a minimum number of flakes outside of the magnetic field applied via the pattern are re-oriented, thereby resulting in a clear pattern image formed by the flakes in the release coating.

Further objects, features, and advantages of the present invention will be apparent from the following detailed description taken in conjunction with the accompanying drawings.

DETAILED DESCRIPTION OF THE INVENTION

The present invention provides a pan holder for holding a container such as a pan or other article of cookware during the process of applying a coating material thereto. The present invention will be described in detail herein with respect to the exemplary application of a process for applying a non-stick release coating to the interior surface of a pan blank. It should be understood, however, that the present invention is not limited to processes for the application of coatings to cookware, but may find application in processes for applying coatings to a variety of other containers and articles. In addition, it should be understood that a pan holder in accordance with the present invention is not limited to use in processes for the application of a non-stick release coating to the inside surface of a container, but may be applied in processes for applying various other types of coatings to other surfaces of such containers or articles.

Figure 1:
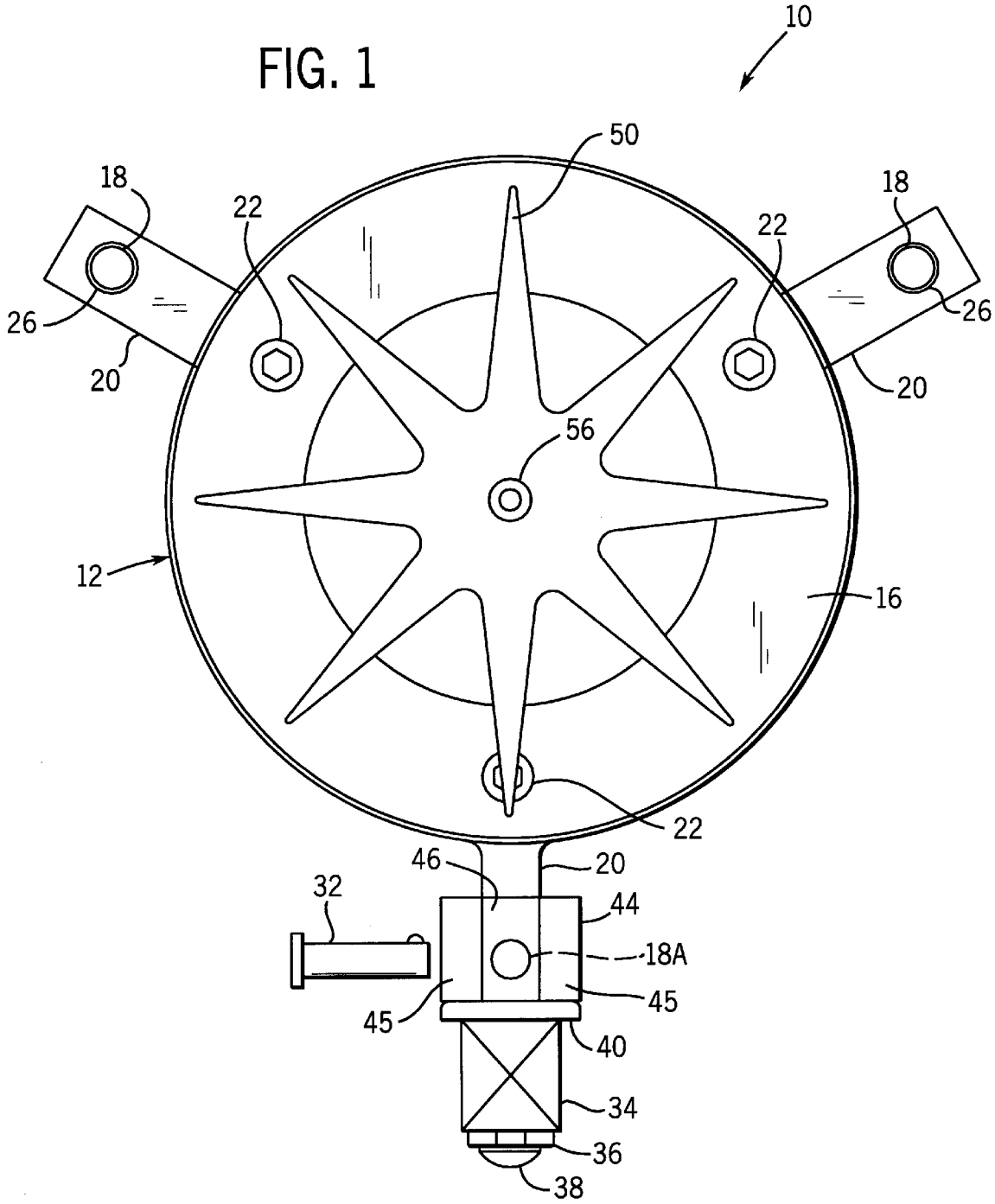
FIG. 1 is a plan view of an exemplary pan holder in accordance with the present invention, having a star shaped magnetizable die pattern attached thereto.

An exemplary pan holder 10 in accordance with the present invention is illustrated in, and will be described in detail with reference to, FIGS. 1 and 2. The two main components of a pan holder 10 in accordance with the present invention are a pan holding means 12 and a chuck 14 attached to the pan holding means 12. The pan holding means includes a bottom support piece 16, and a plurality of pan support rods 18 extending vertically from and attached to the bottom support piece 16. The bottom support piece 16 may be formed as a round circular or ring-shaped plate, and is preferably made of a non-magnetic material, such as aluminum. It should be understood that the bottom support piece 16 may have a different shape than that illustrated by example in FIGS. 1 and 2, and may be made of other appropriate materials.

The support rods 18 may be attached directly to the bottom support piece 16 in a conventional manner. Alternatively, as illustrated in FIGS. 1 and 2, the support rods 18 may be attached to the bottom support piece 16 via support arms 20 which are attached to and extend radially from the bottom support piece 16. The radially extending support arms 20 may be attached to a bottom surface of the bottom support piece 16 (as illustrated in FIGS. 1 and 2), to a top surface of the bottom support piece 16, or to the radial edge of the bottom support piece 16. The radially extending support arms 20 may be attached securely to the bottom support piece in a conventional manner, e.g., using conventional fasteners 22, such as bolts or screws, or may be integrally formed as part of the bottom support piece 16.

The pan support rods 18 may be attached to the support arms 20 (or directly to the bottom support piece 16) in a conventional manner. For example, the pan support rods 18 may be formed as threaded rods, made out of stainless steel or another appropriate material, adapted to be threaded into threaded holes formed in the support arms 20 (or bottom support piece 16). The support rods 18 preferably extend vertically, or approximately vertically, i.e., at approximately a right angle, from the bottom support piece 16. The pan support rods 18 are preferably spaced apart from each other at equal distances from each other along the circumference of an imaginary circle, centered on an axis of the pan holder 10. Thus, the pan support rods 18 are positioned with respect to each other so as to support a round pan blank 24, or other article of cookware, positioned in the pan holding means 12 between the support rods 18. Of course, the pan support rods 18 may be positioned in a different configuration with respect to each other for holding a differently shaped article in the pan holder 10.

Each vertical support rod 18 preferably has a cap 26 or other structure attached to the distal end thereof and made of a relatively compliant material, such as silicone or a compliant plastic material. The support rod caps 26 are preferably made of a material selected to provide a high degree of friction between the cap 26 and the pan blank 24 held in the pan holder 10, to provide a better grip by the support rods 18 on the pan blank 24, while preventing scratching or other abrasion of the wall of the pan blank 24 where the pan blank 24 and the support rods 18 come in contact.

Preferably at least three pan support rods 18 are provided on the pan holding means 12. Preferably at least one of the support rods 18 is a moveable support rod 18A. The moveable support rod 18A is biased inwardly in a radial direction such that when a pan blank 24 is positioned in the pan holding means 12, between the movable support rod 18A and the other support rods 18, the movable support rod 18A presses the pan blank 24 against the other support rods 18, thereby to hold the pan blank 24 firmly in position in the pan holding means 12.

Various mechanisms may be employed for biasing the movable support rod 18A inwardly in a radial direction. For example, the movable support rod 18A may be attached in a hinged relation to a radially extending support arm 20 with a compression spring mechanism mounted on the support arm 20 to bias the movable support rod 18A inward in a radial direction about the hinge. For exemplary purposes only, the movable support rod 18A may be attached to a yoke shaped movable support rod holder 28, e.g., by threading the movable support rod 18A into a threaded aperture formed in the top 29 of the movable support rod holder 28. The movable support rod holder 28 is positioned over the radially extending support arm 20 such that a hole 30 formed in the support rod holder 28 is aligned with a corresponding hole formed through the radially extending support arm 20. A pin 32 (see FIG. 1), such as a cotterless clevis pin, is extended through the aligned holes 30 to thereby attach the movable support rod 18A via the movable support rod holder 28 in a hinged relation to the radially extending support arm 20. This mechanism provides the distal end of the movable support rod 18A with a limited degree of radial movement. The movable support rod 18A may be biased inward in a radial direction by a compression spring 34 mounted on the radially extending support arm 20. A conventional compression spring (e.g., Lee Spring part no. LC-095J-2M) may be employed. The compression spring 34 is compressed between two washers, a fixed washer 36 positioned at the distal end of the support arm 20, and held in place thereon in a conventional manner, such as by a bolt, screw, or other fastener 38 attached to the distal end of the support arm 20, and a movable washer 40. (The moveable washer 40 may preferably include a cylindrical extension portion 41 extending axially therefrom and positioned around the support arm 20 between the support arm 20 and the inside surface of the compression spring 34, to minimize other than axial movement of the washer 40.) The movable washer 40 is biased by the compression spring 34 against the movable support rod holder 28. The movable washer 40 thus transfers the spring loaded tension provided by the compression spring 34 to the movable support rod holder 28. If the support rod 18A is rotated about the support arm 20, such that the movable support rod 18A moves outwardly in a radial direction, the compression spring 34 will bias the movable support rod 18A back to a near vertical position, i.e., radially inward. Thus, the compression spring 34 acts to bias the movable support rod 18A in an inward radial direction, to thereby hold a pan blank 24 in position between the movable support rod 18A and the other support rods 18.

A pan blank 24 or other article of cookware to be held in a pan holder 10 in accordance with the present invention may have one or more handle studs 42 formed on and extending from an outer wall thereof. The handle studs 42 may be formed as an integral part of the pan blank 24, and are used to attach a handle to the blank 24 to form a complete pan or other article of cookware after a surface coating has been applied thereto and other processing of the pan blank 24 has been completed. Preferably, one of the pan support rods 18 in a pan holder 10 in accordance with the present invention includes a handle stud engaging means attached thereto for engaging the handle studs 42 extending from the pan blank 24. The pan handle stud engaging means is preferably attached to the distal end of the moveable support rod 18A. For example, as illustrated in FIGS. 1 and 2, a pan handle stud engaging means 44 may be attached to the distal end of the movable support rod 18A, e.g., by threading the pan handle stud engaging means 44 onto the distal end of the threaded movable support rod 18A. The pan handle stud engaging means 44 is preferably made of a semi-rigid material such as Nylatron, or a similar plastic material, which will provide a degree of friction between a surface of the pan handle stud engaging means 44 and the outer surface of the pan blank 24 without scratching or otherwise damaging the outer surface of the pan blank 24. The pan handle stud engaging means 44 preferably includes two extending portions 45 defining a notch 46 therebetween. The width of the notch 46 is preferably only slightly larger than the width of the pan handle studs 42 extending from the outer surface of the pan blank 24. Thus, when the pan blank 24 is positioned in the pan holding means 12 between the support rods 18 such that the pan handle studs 42 are positioned in the notch 46 formed in the pan handle stud engaging means 44, rotational movement of the pan blank 24 in the pan holder 10 is prevented. Thus, the pan handle stud engaging means 44 provides additional support against movement of a pan blank 24 held in position in the pan holder 10 of the present invention.

The two main components of the pan holder chuck 14 are a chuck shaft 46 and a pulley 48. The chuck shaft 46 extends vertically downward from the pan holding means 12. The chuck shaft 46 is designed to ride in the central aperture of a link in a conveyor chain in a chain-on-edge spray line. The pan holder 10 is mounted on the conveyor chain by extending the shaft 46 through the central aperture of a link in the chain, and is rotated with respect to the chain about the shaft 46. The shaft 46 may preferably be tapered slightly, as illustrated in FIG. 2.

The pulley 48 is mounted around the shaft 46. The pulley 48 may be attached to the shaft 46 in a conventional manner, or may be integrally formed as part of the shaft 46. The pulley 48 may be attached in a fixed position on the shaft 46, or may be attached to the shaft 46 in a manner such that the position of the pulley 48 on the shaft 46 may be adjusted. For example, the pulley 48 may be attached to the shaft 46 using a set screw (not shown), which may be loosened to adjust the position of the pulley 48 on the shaft 46. The pulley 48 is positioned on the shaft 46 so as to be engaged by a drive belt as the pan holder 10 is transported through a coating application station by a conveyor chain. The drive belt engages the pulley 48 to rotate the pan holder 10 about the shaft 46 during the application of a coating material to the pan blank 24. The position of the pulley 48 on the shaft 46 is preferably made adjustable so as to adjust the position of the pulley 48 for engaging drive belts mounted at different distances from a conveyor chain.

The pan holder chuck 14 may be attached to the pan holding means 12 in a conventional manner. For example, the chuck shaft 46 may be attached directly to the bottom support piece 16.

A pan holder 10 in accordance with the present invention is preferably adapted for use in a process for forming a pattern in a non-stick coating release layer applied to a pan or other article of cookware by the magnetic reorientation of reflective magnetizable flakes distributed in the non-stick coating material as it is applied to the pan. For such applications, a pan holder 10 in accordance with the present invention preferably includes a magnetizable die pattern 50 and a magnet 52 for applying magnetic force to the die pattern 50.

The die pattern 50 is made out of a magnetizable material, such as stainless steel. The die pattern 50 is formed in the shape of the pattern to be formed in the non-stick release coating applied to the pan blank 24. The die pattern 50 may be formed in any desired shape. For exemplary purposes only, a die pattern 50 formed as a plate of magnetizable material shaped in a star pattern is illustrated in FIGS. 1 and 2. (It has been found that a star shaped pattern formed by reoriented metal flakes in a non-stick release coating applied to a pan provides improved heat distribution across the pan surface when the pan is used for cooking.) Alternatively, the die pattern 50 may be in the form of sheet metal bent into a desired pattern and mounted on the pan holding means 12 at an angle with respect to the plane of the underside of the pan blank 50 so that the upper edge, and not the face, of the sheet metal forms the pattern (i.e., the die pattern looks like a cookie cutter). The die pattern 50 is attached to the bottom support piece 16 of the pan holding means 12, between the pan support rods 18. Thus, when a pan blank 24 is held in position in the pan holding means 16 by the support rods 18, the bottom outside surface of the pan blank 24 is held in contact with an upper surface of the die pattern 50. As discussed previously, the support rods 18 function to hold the pan blank 24 in position in the pan holder 10, and thus hold the pan blank 24 firmly in position with respect to the die pattern 50. The die pattern 50 may be attached to the bottom support piece 16 in a conventional manner.

The magnet 52 may be a permanent magnet or an electromagnet. An exemplary permanent magnet which may be employed is Dexter Magnetics NEO-37 Alloy Rare Earth Magnet, Part. No. CM40978-3714. The magnet 52 may be attached directly to the die pattern 50, to magnetize the die pattern 50, thereby generating magnetic lines of force in the shape of the die pattern 50 through the pan blank 24 to the inside surface thereof. It has been found, however, that if the magnet 52 is coupled directly to the die pattern 50 background effects will be present in the magnetic field extending through the pan blank 24. By background effects is meant magnetic force passing through the pan blank 24 which will operate on magnetizable flakes in a coating material applied to the inside of the pan blank 24 outside of the edges of the desired pattern, causing such flakes to move out of planer configuration. Such background effects cause unwanted fuzziness or increased darkness of the pattern edges.

Unwanted background effects can be reduced or eliminated if the magnetic force provided by the magnet 52 is diffused before being applied to the die pattern 50. The magnetic force provided by the magnet 52 may preferably be diffused by interposing a spacer piece 54 between the magnet 52 and the die pattern 50. The spacer piece 54 is preferably formed of a magnetic material and is sized so as to provide a desired degree of diffused magnetic force at the die pattern 50 to re-orient reflective magnetizable flakes distributed in a non-stick coating material applied to the inside of the pan blank 24 while eliminating background effects. The size of the spacer piece 54 and magnet 52 are preferably selected such that the area of the face of the magnet 52 is smaller than, and totally contained within, the area of the face of the spacer plate 54, so that lines of force from the magnet 52 cannot pass directly to the pan blank 24 or other article being coated, thereby creating background effects.

The die pattern 50 may be attached to the spacer piece 54 in a conventional manner. For example, the spacer piece 50 may have a threaded hole 56 formed therethrough or thereon. The spacer piece 54 may have a corresponding threaded insert extending therefrom. The die pattern 50 may be attached to the spacer piece 54 by threading the die pattern hole 56 around the threaded insert extending from the spacer piece 54.

The spacer piece 54, in turn, may be attached to the bottom support piece 16 of the pan holding means 12 in a conventional manner. For example, as described previously, the bottom support piece 16 may be formed in a ring shape, having a central aperture formed therein. The spacer piece 54 may be mounted in the central aperture of the ring-shaped bottom support piece 16. The spacer piece 54 may be securely attached to the bottom support piece 16 in a conventional manner. For example, a screw, bolt, or other fastener may be extended through a fastener hole 58 formed in the edge of the support piece ring 16 which is aligned with a similar fastener hole formed in a side of the spacer piece 54. (As described previously, the bottom support piece 16 is preferably made of a non-magnetic material, e.g., aluminum, so as not to effect the magnetic force applied by the magnet 52 through the spacer piece 54 to the die pattern 50.)

The magnet 52 is attached to an end of the spacer piece 54 opposite the die pattern 50. The magnet 52 may be attached to the spacer piece 54 in a conventional manner. For example, where the spacer piece 54 is made of a magnetic material, magnetic attraction between the magnet 52 and the spacer piece 54 alone is sufficient to attach the magnet 52 to the spacer piece 54. Alternatively, a conventional fastener structure may be used to attach the magnet 52 to the spacer piece 54.

Figure 2:
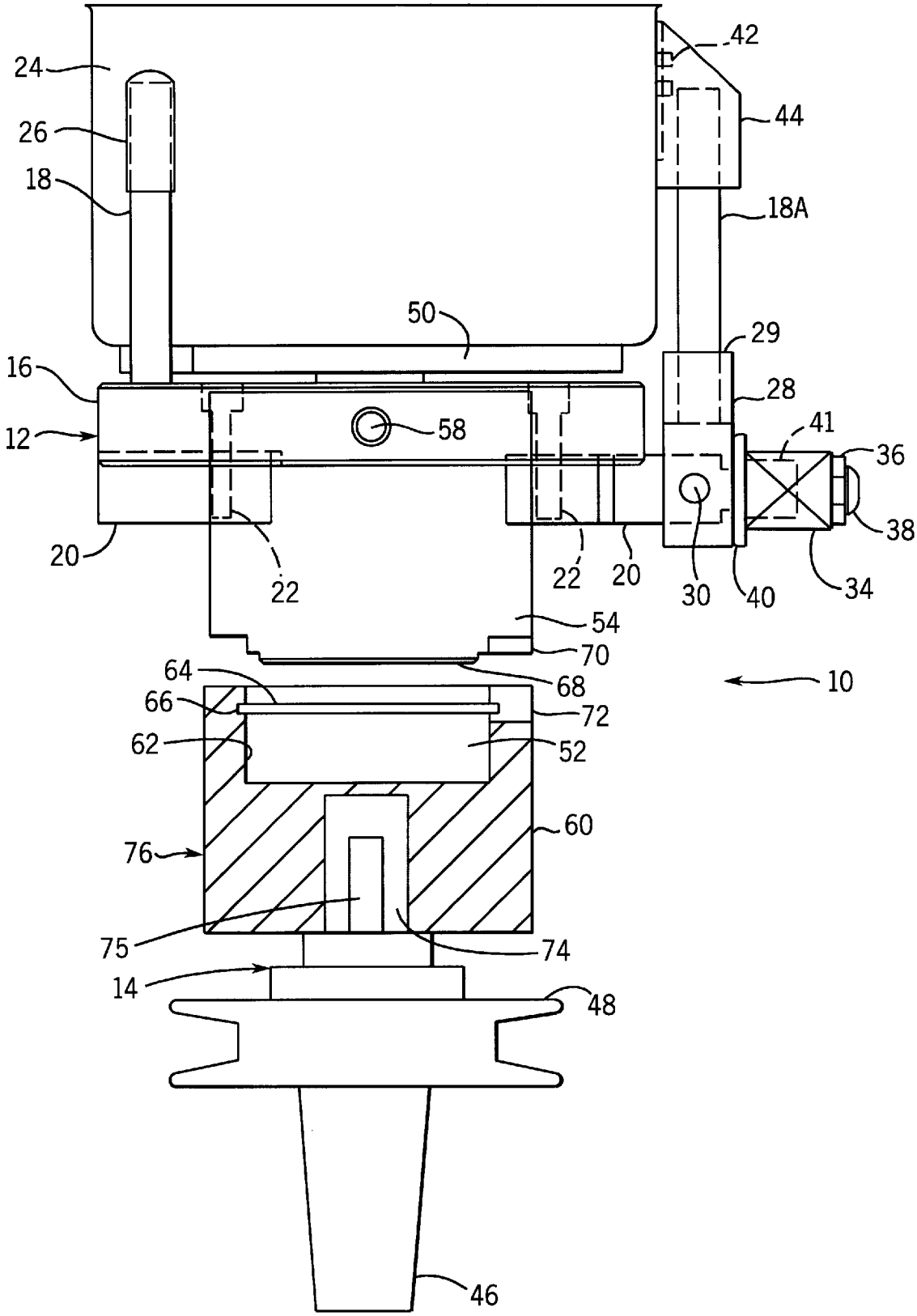
FIG. 2 is a side view, in partial cross-section, of the pan holder of FIG. 1, showing a pan or other article of cookware held thereon, and wherein a magnet/chuck assembly is shown separated from the other portions of the pan holder.

As illustrated in FIG. 2, the magnet 52 is preferably contained in a magnet housing 60. The magnet housing 60 is preferably made of a non-magnetic material, such as Nylatron, or another plastic material. The magnet 52 is placed in a recess 62 formed in the upper surface of the magnet housing 60. A thin piece of plastic 64 or other material may be positioned in a groove 66 formed around the recess 62 formed in the magnet housing 60, to retain the magnet 52 in the recess 62.

The magnet housing 60 may preferably have the same or similar diameter as the spacer piece 54. The spacer piece 54 may be provided with a stepped bottom 68, which corresponds in shape to a portion of the recess 62 formed in the magnet housing 60 which is not occupied by the magnet 52 or magnet retaining piece 66. The magnet housing 60 may be attached in proper alignment to the spacer piece 54 by inserting the stepped bottom 68 of the spacer piece 54 into the recess 62 formed in the magnet housing 60. The magnetic force provided by the magnet 52 holds the magnet 52 and the magnet housing 60 in position on the spacer piece 54. A notch 70 or extending tab may be formed on the spacer piece with a corresponding tab or notch 72 formed on the magnet housing 60. The tab or notch 70 on the spacer piece 54 is aligned with the notch or tab 72 formed in the magnet housing 60 when the magnet housing 60 is attached to the spacer piece 54. Engagement between the notch and tab structures 70 and 72 on the spacer piece 54 and magnet housing 60 ensure proper alignment between the spacer piece 54 and magnet housing 60, and further act to prevent rotation of the spacer piece 54 with respect to the magnet housing 60.

The pan holder chuck 14, including the shaft 46 and pulley 48, may be attached to the bottom of the magnet housing 60, opposite the end of the housing 60 which contains the magnet 52. A recess 74 may be formed in the bottom of the magnet housing 16, whereby the chuck 14 may be attached to the housing 60 by inserting an extending portion 75 of the chuck shaft 46 into the recess 74, and securing the extending portion 75 of the shaft 46 in the recess 74 in a conventional manner, such as by threading the extending portion 75 of the shaft 46 into the recess 74, or by using a screw, bolt, or other fastener to secure the extending portion 75 of the shaft 46 in the receptacle formed by the recess 74 in the magnet housing 60. The chuck 14 also may be attached to the magnet housing 60 in any other conventional manner.

It is apparent that the spacing between the support rods 18 defines the size of the pan blank 24 which may be held in a pan holder 10 in accordance with the present invention. Of course, the support rods 18 may be spaced apart at any distance, to hold, for example, 7, 8, 10, or 12-inch diameter pan blanks 24 in the pan holder 10. The height of the support rods 18 may also be optimized for holding pan blanks 24 of selected height between the support rods 18. For example, the height of the support rods 18 may be selected to hold one quart or two quart capacity pan blanks 24, or a griddle pan blank 24. The position and height of the support rods 18 may be made adjustable, so that a particular pan holder 10 may be adjusted to hold variously sized pan blanks 24. For example, the support rods 18 and/or support arms 20 may be made telescoping to adjust to the sizes thereof. Alternatively, the support rods 18 may be mounted in a fixed position on the pan holding means 16, such that different pan holding means 16 are required to hold differently sized pan blanks 24.

Where different pan holding means 16 are required to hold differently sized pan blanks 24, considerable cost savings may be achieved if a single magnet 52 and chuck 14 may be used in combination with various different pan holding means 12 adapted to receive and hold variously sized pan blanks 24. For this purpose, the magnet housing 60, including the magnet 52, and the chuck 14, including the shaft 46 and pulley 48, are preferably provided as a magnet/chuck assembly 76, as illustrated in FIG. 2. The magnet housing 60 of the magnet/chuck assembly 76 is preferably sized and shaped such that the magnet/chuck assembly 76 is adapted to be attached to various different pan holding means 12 adapted to hold variously sized pan blanks 24. The bottom surfaces of the spacer pieces 54 employed in variously sized pan holding means 12 may have the same stepped or contoured bottom shape 68 and notch or tab structure 70 such that the universally adapted magnet/chuck assembly 76, having a correspondingly shaped recess 62 and tab/notch structure 72 formed in the magnet housing 60 thereof, may be attached to the various pan holding means 12 via the spacer pieces 54. Note that the magnet/chuck assembly 76 may be held in place on the spacer piece 54, which is made of a magnetic material, by the magnetic force of the magnet 52 in the magnet housing 60. The magnet 52 provides sufficient magnetic force to hold the magnet/chuck assembly 76 on the spacer piece 54 for most applications. For more demanding applications, a fastener, such as a screw, bolt, or other fastener, may be used to secure the magnet housing 60 to the spacer piece 54.

A pan holder 10 in accordance with the present invention is used for holding a pan blank 24 during the process of applying a coating material to the pan blank 24. A pan holder 10 in accordance with the present invention is particularly adapted for use on a chain-on-edge spray line. In a chain-in-edge spray line, a pan blank 24 is transported by a conveyor chain through various stations wherein a coating material is applied to the inner surface of the pan blank 24 by spraying the coating material thereon as the pan blank 24 is rotated.

Figure 3:
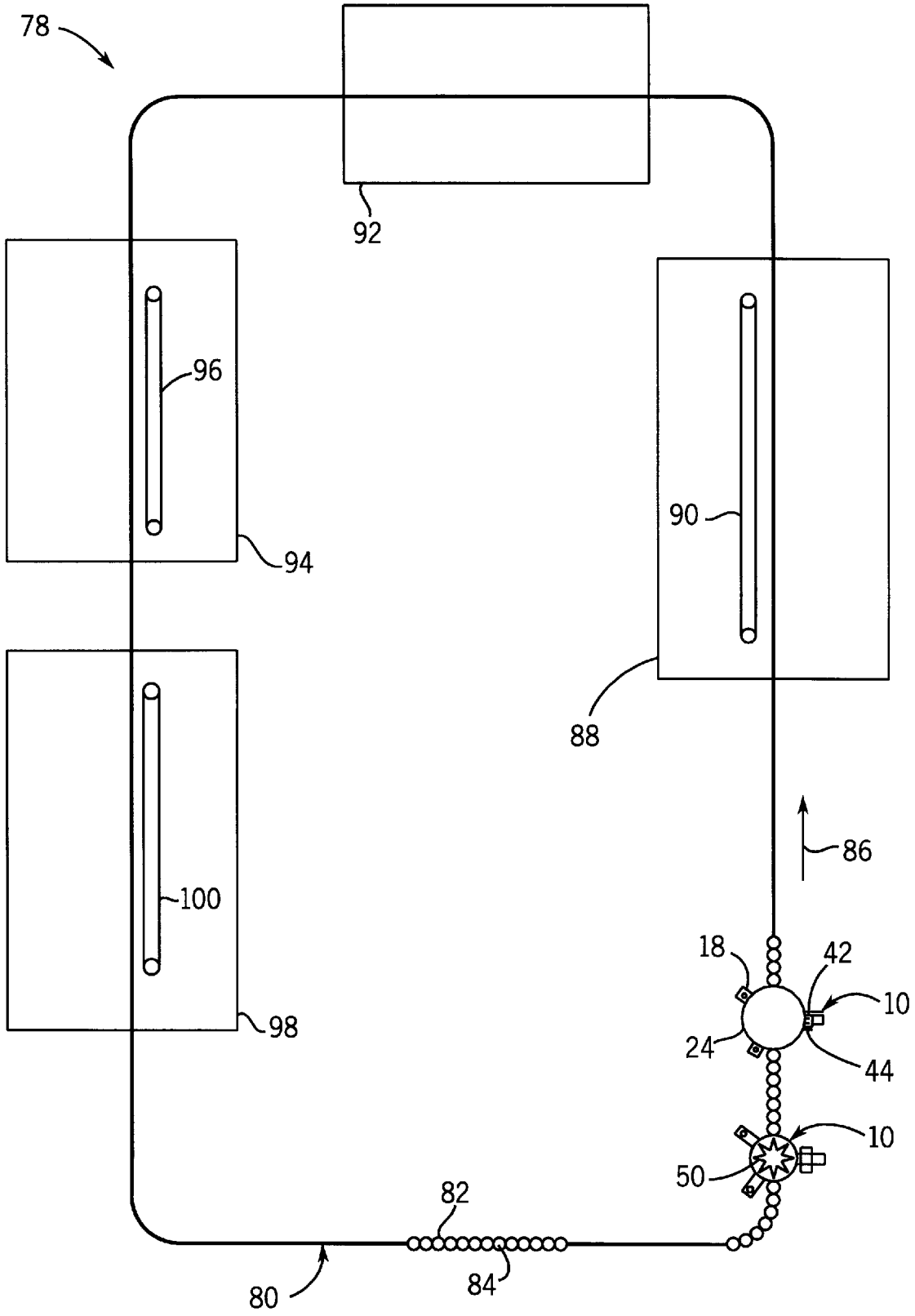
FIG. 3 is a schematic illustration of a chain-on-edge spray line for applying a non-stick release coating to the inside surface of a pan or other article of cookware, illustrating an exemplary application of a pan holder in accordance with the present invention.

A schematic illustration of an exemplary chain-on-edge spray line 78, with which a pan holder 10 in accordance with the present invention is particularly adapted for use, is presented in FIG. 3. The chain-on-edge spray line 78 employs a conveyor chain 80 for transporting pan blanks 24 through various coating material application and drying stations. The conveyor chain 80 includes a string of conveyor chain links 82 (only a portion of which are illustrated in FIG. 3). Each link 82 in the conveyor chain 80 has a central aperture 84 formed therein, which opens in an upward direction. The central aperture 84 in each conveyor chain link 82 is adapted to receive the shaft 46 extending from the chuck 14 of a pan holder 10 in accordance with the present invention. Multiple pan holders 10 in accordance with the present invention are mounted spaced apart on the conveyor chain 80, by extending the chuck shaft 46 of each pan holder 10 through a central aperture 84 in one of the links 82 of the conveyor chain 80. For exemplary purposes only, the conveyor chain 80 may be a 2½ inch pitch chain with chain links 82 positioned thereon such that every 2½ inches along the chain 80 there is a place to mount a pan holder chuck 14 to the chain 80. (Only two pan holders 10 are shown mounted on the conveyor chain 80 in FIG. 3.) For exemplary purposes only, 55 pan holders 10 in accordance with the present invention may be mounted on a conveyor chain 80 in the manner described, with the centers of each pan holder 10 positioned on the conveyor chain 80 spaced approximately 18 inches apart.

An exemplary coating process employing a pan holder 10 in accordance with the present invention will now be described with reference to FIG. 3. In this exemplary process, a non-stick release coating is formed on the inner surface of a pan blank 24. A pattern is formed in the release coating by the magnetic re-orientation of reflective magnetizable metal flakes distributed in the release coating material. It should be understood that a pan holder 10 in accordance with the present invention may be used for other coating processes, and for applying coating materials to articles other than a pan blank 24 or another article of cookware. More details on the process of and materials used in the coating process to be described may be found in U.S. patent application Ser. Nos. 09/144,766 and 09/144,775, both filed on Sep. 1, 1998, the disclosures of which are incorporated herein by reference the first respective application now U.S. Pat. No. 6,103,361.

The coating application process begins by placing a pan blank 24 in a pan holder 10 in accordance with the present invention which is mounted on the conveyor chain 80. As described previously, the pan holder 10 includes support rods 18 which hold the pan blank 24 in position on the pan holder 10. The pan blank 24 may have pan handle studs 42 extending therefrom, which are preferably engaged by a handle stud engaging means 44 attached to a movable support arm 18A. As described previously, the movable support arm 18A is biased against an outer surface of the pan blank 24, to hold the pan blank 24 in position against the other support rods 18. The support rods 18 also hold the pan blank 24 in position against a magnetized die pattern 50 attached to the pan holder 10. The pan blank 24 may be any size, provided that a pan holder 10 having support rods 18 of the appropriate height and spacing for holding the pan blank 24 in position is provided. The pan blank 24 may be made of any non-magnetizable material which can withstand the relatively high bake temperatures used to fuse the non-stick release coating materials which will be applied to the pan blank 24. Such substrate materials include, for example, metals and ceramics, such as aluminum, anodized aluminum, stainless steel, enamel, glass, and pyrocerum, among others.

A pan blank 24 placed in a pan holder 10 in accordance with the present invention is transported by the conveyor chain 80, in the direction indicated by arrow 86, through a first station 88 wherein a primer coating material is applied to the interior surface of the pan blank 24. A primer coating material is used to improve adhesion between a non-stick release coating material containing reflective magnetizable metal flakes and the surface of the pan blank substrate 24. The use of a primer coating layer is optional, but is particularly important where the interior surface of the pan blank 24 is smooth, as preferred. Adhesion to the interior surface of the pan blank 24 can be improved if the interior surface is grit blasted (roughened) prior to coating. For pyrocerum and some glass, improved results are obtained by activation of the substrate surface such as by a slight chemical etch, which is not visible to the naked eye. The substrate can also be chemically treated with an adhesion agent, such as the mist coat of polyamic acid salt disclosed in U.S. Pat. No. 5,079,073 (Tannenbaum), hereby incorporated by reference.

The primer coating material, if used, may be derived from an aqueous dispersion of at least one fluoropolymer and a water soluble or water dispersible film-forming polymer binder material. Suitable primer materials are described in U.S. Pat. No. 4,014,834 (Concannon), U.S. Pat. No. 4,087,394 (Concannon), U.S. Pat. No. 5,240,775 (Tannenbaum), U.S. Pat. No. 5,250,356 (Batzar), and U.S. Pat. No. 5,562,991 (Tannenbaum). The film-forming polymer binding component that may be used in forming the primer coating is composed of a polymer which is thermally stable. This component is well known in primer applications for non-stick finishes, for adhering the fluoropolymer-containing primer layer to substrates and for film-forming within and as part of the primer layer. The binder is generally non-fluorine containing and yet adheres to both the fluoropolymer and the substrate. Preferred binders are those that are soluble or solubilized in water or a mixture of water and organic solvent for the binder, which solvent is miscible with water, although solvent-soluble polymer binders can be used in coating compositions in which the liquid vehicle is organic solvent. This solubility aids in the blending of the binder with the fluorocarbon component in the aqueous dispersion form. Polyethersulfone is one example of a thermally stable polymer binder. A preferred binder component is polyamic acid salt, which converts to polyamideimide upon baking of the composition to form the primer layer. An inorganic filler film hardener component may also be present in the primer composition. The film hardener is one or more filler type materials which are inert with respect to the other components of the composition and thermally stable at baking temperatures which fuse the fluoropolymer and binder. Preferably the film hardener is water insoluble so that it is uniformly dispersible but not dissolved in an aqueous dispersion. Examples of a film hardener include one or more metal silicate compounds, such as aluminum silicate, and metal oxides, such as titanium dioxide and aluminum oxide. The primer composition, in aqueous dispersion form, may also contain such other additives as adhesion promoters, such as colloidal silica, or a phosphate compound, such as a metal phosphate, e.g., Zn, Mn, or Fe phosphate.

The primer material, in liquid form, is applied to the interior surface of the pan blank 24 by spraying the material from a nozzle (not shown) onto the interior surface of the pan blank 24 in the primer application station 88. (The primer coating, when used, may be applied to a thickness of 0.5 to 10 micrometers.) To ensure an even application of the primer material onto the pan blank 24, the pan blank 24 is rotated while the primer material is sprayed onto the interior surface thereof. The pan blank 24 is rotated by a drive belt 90. The drive belt 90 is positioned in the primer application station 88 adjacent to the conveyor chain 80 such that the pulley 48 on the chuck 14 of the pan holder 10 is engaged by the drive belt 90 when the pan holder 10 transported through the primer application station 88 by the conveyor chain 80. The moving drive belt 90 engages the pulley 48 to rotate the pan holder 10, and the pan blank 24 held therein, about the chuck shaft 46. As the pan holder 10 is transported by the moving conveyor chain 80 out of the primer application station 88, the pulley 48 is disengaged from the drive belt 90, and rotation of the pan holder stops.

Following the primer application station 88, the conveyor chain 80 transports the pan holder 10, with the pan blank 24 held therein, through a drying tunnel 92. In the drying tunnel 92, hot air, such as hot air heated by steam, is used to dry the primer coating material applied to the interior surface of the pan blank 24 in the primer application station 88. Since the pan blank 24 need not be rotated in the drying tunnel 92, a drive belt 90 is not provided therein.

After the primer coating material has been dried in the drying tunnel 92, the conveyor chain 80 transports the pan blank 24 through an intermediate coating application station 94, wherein a non-stick release coating material having reflective magnetizable flakes dispersed therein is applied to the interior surface of the pan blank 24, over the primer coating layer. The intermediate coating layer material may be applied in a manner similar to that by which the primer coating material was applied, i.e., by spraying the intermediate non-stick release coating material onto the interior surface of the pan blank 24 while rotating the pan blank 24. Thus, as in the primer coating application station 88, a drive belt 96 is provided in the intermediate coating application station 94, to engage the pulley 48 on the pan holder 10, thereby to rotate the pan holder 10, and the pan blank 24 held therein, while the intermediate coating material is applied thereto.

The intermediate release coating material applied to the pan blank 24 in the intermediate coating material application station 94 is preferably a liquid fluoropolymer composition containing magnetizable flakes. The fluoropolymer component is generally commercially available as a dispersion of polymer in water, which is the preferred form of the composition for ease of application and environmental acceptability. The fluoropolymer/flake coating composition is preferably derived from a dispersion of one or more fluoropolymers to which has optionally been added a dispersion of an acrylic polymer. Exemplary fluoropolymer materials which may be employed for the intermediate coating are described in U.S. Pat. No. 4,180,609 (Vassiliou), U.S. Pat. No. 4,118,537 (Vary & Vassiliou), U.S. Pat. No. 4,123,401 (Berghmans & Vary), and U.S. Pat. No. 4,351,882 (Concannon), hereby incorporated by reference. Acrylic polymer dispersions are described in U.S. Pat. No. 4,123,401 (Berghmans & Vary) and U.S. Pat. No. 4,118,537 (Vary & Vassilou), hereby incorporated by reference. The reflective flakes used in the release coating material should be made of a material which, while magnetizable, is ineffected by the high temperatures (350° C. to 420° C.) required to sinter or otherwise fuse the fluoropolymer material forming the release coating. Examples of materials from which the flakes can be made include such metals as iron and nickel and alloys containing these metals, with stainless steel being the preferred material. The magnetizable flakes preferably include flakes which have a longest dimension which is slightly greater than the thickness of the layer formed from the coating composition which contains the flakes. The intermediate coating thickness will generally be from 5 to 40 micrometers. The flake size will then depend on the coating thickness desired.

The magnetizable flakes in the intermediate layer of coating material will naturally align themselves parallel with the surface of the interior of the pan blank 24 to which the material is applied. However, while the coating of fluoropolymer composition containing the magnetizable flakes is still liquid, the flakes are mobile, and thus can be re-oriented perpendicular to the interior pan blank surface by an applied magnetic force. In this case, the magnet 52, spacer piece 54, and die pattern 50 act to apply a magnetic force in the shape of the die pattern 50 to the coating composition simultaneously with the application of the liquid coating composition to the pan blank 24. This provides the best opportunity for obtaining perpendicular flake re-orientation. The reoriented reflective magnetizable flakes thus create a pattern, in the shape of the die pattern 50, in the intermediate release coating layer. As discussed previously, since the pan holder 10 of the present invention holds the pan blank 24 in position with respect to the die pattern 50, so as to prevent movement of the pan blank 24 with respect to the die pattern 50 during the application of the intermediate non-stick coating material containing the magnetizable flakes thereto, a distinct, sharp-edged pattern is formed in the intermediate release coating layer, i.e., fuzziness of the created pattern is minimized.

After the intermediate release coating material, including the re-oriented reflective magnetizable flakes, is applied to the pan blank 24 at the intermediate coating application station 94, the pan blank 24 may be transported through a top coat application station 98, wherein a top coat of non-stick release coating material is applied over the intermediate coating layer. The top coat material may be applied over the intermediate coating layer in the same manner as the primer and intermediate coating materials are applied, i.e., the top coat material may be sprayed onto the interior of the pan blank 24, over the intermediate coating, as the pan blank 24 is rotated. Thus, a drive belt 100 is provided in the top coat application station 98 to engage the pulley 48 attached to the pan holder 10, to thereby rotate the pan blank 24 held therein.

The composition forming the top coat layer is preferably the same as or similar to the non-stick release coating material applied as the intermediate coating layer, but without the magnetizable metal flakes dispersed therethrough. The top coat layer may be applied to a thickness of 2.5 to 10 micrometers. The top coat layer provides additional protection and wear resistance over the non-stick intermediate release coating, and smoothes out the interior surface of the pan blank 24 where vertically re-oriented flakes in the intermediate release coating which are longer than the thickness of the intermediate release coating protrude therefrom. The composition forming the top coat may contain mica particles, or mica particles coated with pigment. Such particles impart scratch resistance to the articles on which they are coated. Exemplary mica particles coated with pigment which may be employed are described in U.S. Pat. No. 3,087,827 (Klenke and Stratton), U.S. Pat. No. 3,087,828 (Linton), and U.S. Pat. No. 3,087,829 (Linton), hereby incorporated by reference.

It should be noted that the compositions forming the primer, intermediate, and top coatings may also contain one or more pigments, normally in a mill-base medium that is either soluble in or miscible with the water of the fluoropolymer aqueous dispersion. Pigments for use in cookware applications have limitations imposed on their use by the U.S. Food and Drug Administration (FDA) because of food contact. Pigments to be used in cookware must be heat stable and non-toxic. Suitable pigments include at least one member from the group of: carbon black, titanium dioxide, iron oxide, and zeolites, such as ultra marine blue, and cobalt blue, among others. Preferably, the amount of pigment included in the intermediate and top coatings is sufficient to add a color tone to the non-stick release coating applied to the interior surface of the pan blank 24, without obscuring the pattern formed by the re-oriented reflective magnetizable flakes in the intermediate coating layer.

After the top coat has been applied to the pan blank in the top coat application station 98, the pan blank 24 may be removed from the pan holder 10 for drying and baking of the coating layers applied thereto, to sinter or otherwise fuse the fluoropolymer layers to form the release coating, by heating the coating layers typically to temperatures of 350° C. to 420° C., depending on the fluoropolymer resins used. The pan blank 24 may then be further processed in a conventional manner to complete the article of cookware.

It should be understood that the present invention is not limited to the particular exemplary embodiments and applications illustrated and described herein, but embraces all modified forms thereof as come within the scope of the following claims.

What is claimed is:

1. A pan holder, comprising:

(a) a holding means including a bottom support piece and a plurality of pan support rods extending from the bottom support piece to hold a pan in position between the pan support rods, at least one of the pan support rods is a moveable pan support rod biased in a radial direction to hold a pan in postion between the pan support rods; and (b) a pan holder chuck attached to the pan holding means and including a chuck shaft extending in an axial direction from the pan holding means and a pulley mounted to the chuck shaft.

2. The pan holder of claim 1 wherein the moveable pan support rod is attached in a hinged relation to a support arm extending radially from the bottom support piece.

3. The pan holder of claim 1 wherein the moveable pan support rod is biased in a radial direction by a compression spring.

4. The pan holder of claim 1 wherein the moveable pan support rod includes means for engaging a handle stud extending from a pan shell attached thereto.

5. The pan holder of claim 4 wherein the means for engaging a handle stud extending from a pan shell includes two extending portions extending from the moveable pan support rod and defining a notch therebetween for engaging the handle stud.

6. The pan holder of claim 1 wherein the plurality of pan support rods are attached to the bottom support piece via support arms extending radially from the bottom support piece.

7. The pan holder of claim 1 wherein the pulley is moveably mounted to the chuck shaft.

8. A pan holder, comprising:

(a) a pan holding means including a bottom support piece and a plurality of pan support rods extending from the bottom support piece to hold a pan in position between the pan support rods;

(b) a die pattern positioned between the pan support rods;

(c) a magnet magnetically coupled to the die pattern; and (d) a pan holder chuck attached to the pan holding means and including a chuck shaft extending in an axial direction from the pan holding means and a pulley mounted to the chuck shaft.

9. The pan holder of claim 8 wherein at least one of the pan support rods is a moveable pan support rod biased in a radial direction to hold a pan in position between the support rods.

10. The pan holder of claim 9 wherein the moveable pan support rod is attached in a hinged relation to a support arm extending radially from the bottom support piece.

11. The pan holder of claim 9 wherein the moveable pan support rod is biased in a radial direction by a compression spring.

12. The pan holder of claim 9 wherein the moveable pan support rod includes means for engaging a handle stud extending from a pan shell attached thereto.

13. The pan holder of claim 12 wherein the means for engaging a handle stud extending from a pan shell includes two extending portions extending from the moveable pan support rod and defining a notch therebetween for engaging the handle stud in the notch.

14. The pan holder of claim 8 wherein the plurality of pan support rods are attached to the bottom support piece via support arms extending radially from the bottom support piece.

15. The pan holder of claim 8 wherein the pulley is moveably mounted to the chuck shaft.

16. The pan holder of claim 8 including additionally a spacer piece positioned between the magnet and the die pattern.

17. The pan holder of claim 16 wherein the bottom support piece is ring shaped, having a central aperture formed therein, wherein the spacer piece is positioned in the central aperture formed in the bottom support piece, and wherein the die pattern is attached to the spacer piece.

18. The pan holder of claim 17 including additionally a threaded insert extending from the spacer piece and wherein the die pattern is attached to the spacer piece by threading the die pattern onto the threaded insert.

19. The pan holder of claim 16 comprising additionally a magnet housing containing the magnet and attached to the spacer piece.

20. The pan holder of claim 19 wherein the magnet housing is attached to the spacer piece by magnetic attraction between the magnet contained in the magnet housing and the spacer piece.

21. The pan holder of claim 19 wherein the magnet housing includes alignment means for aligning the magnet housing with corresponding alignment means formed on the spacer piece.

22. The pan holder of claim 19 wherein the pan holder chuck is attached to the pan holding means by attaching the pan holder chuck to the magnet housing, attaching the magnet housing to the spacer piece, and attaching the spacer piece to the bottom support piece of the pan holding means.

23. A pan holder, comprising:

(a) a bottom support piece; and (b) a plurality of pan support rods, and wherein the plurality of pan support rods are attached to the bottom support piece via support arms extending radially from the bottom support piece and at least one pan support rod is attached in a hinged relation to at least one of the supports arm extending radially from the bottom support piece.

24. The pan holder of claim 23 wherein at least one of the pan support rods is a moveable pan support rod biased in a radial direction to hold a pan in position between the pan support rods.

25. The pan holder of claim 24 wherein the moveable pan support rod is biased in a radial direction by a compression spring.

26. The pan holder of claim 24 wherein the moveable pan support rod includes means for engaging a handle stud extending from a pan shell attached thereto.

27. The pan holder of claim 26 wherein the means for engaging a handle stud extending from a pan shell includes two extending portions extending from the moveable pan support rod and defining a notch therebetween for engaging the handle stud in the notch.

28. The pan holder of claim 23 including additionally a die pattern attached to the bottom support piece and positioned between the pan support rods.

29. The pan holder of claim 28 including additionally a spacer piece attached to the die pattern.

30. The pan holder of claim 29 wherein the bottom support piece is ring shaped, having a central aperture formed therein, and wherein the spacer piece is positioned in the central aperture formed in the bottom support piece.

31. The pan holder of claim 30 including additionally a threaded insert extending from the spacer piece and wherein the die pattern is attached to the spacer piece by threading the die pattern onto the threaded insert.

32. A pan holder, comprising:

(a) a pan holding means including a bottom support piece and a plurality of pan support rods extending from the bottom support piece to hold a pan in position between the pan support rods;

(b) a die pattern positioned between the pan support rods;

(c) a spacer piece attached to the die pattern;

(d) a magnet magnetically coupled to the die pattern via the spacer piece;

(e) a magnet housing containing the magnet attached to the spacer piece; and (f) a pan holder chuck attached to the magnet housing and including a chuck shaft extending in an axial direction from the pan holding means and a pulley mounted to the chuck shaft.

33. The pan holder of claim 32 wherein at least one of the pan support rods is a moveable pan support rod biased in a radial direction to hold a pan in position between the support rods.

34. The pan holder of claim 33 wherein the moveable pan support rod is attached in a hinged relation to a support arm extending radially from the bottom support piece.

35. The pan holder of claim 33 wherein the moveable pan support rod is biased in a radial direction by a compression spring.

36. The pan holder of claim 33 wherein the moveable pan support rod includes means for engaging a handle stud extending from a pan shell attached thereto.

37. The pan holder of claim 32 wherein the plurality of pan support rods are attached to the bottom support piece via support arms extending radially from the bottom support piece.

38. The pan holder of claim 32 wherein the pulley is moveably mounted to the chuck shaft.

39. The pan holder of claim 32 wherein the bottom support piece is ring shaped, having a central aperture formed therein, wherein the spacer piece is positioned in the central aperture formed in the bottom support piece, and wherein the die pattern is attached to the spacer piece.

40. The pan holder of claim 32 wherein the magnet housing is attached to the spacer piece by magnetic attraction between the magnet contained in the magnet housing and the spacer piece.

41. The pan holder of claim 32 wherein the magnet housing includes alignment means for aligning the magnet housing with corresponding alignment means formed on the spacer piece.

* * * * *